US011754312B2

(12) United States Patent
Koop et al.

(10) Patent No.: US 11,754,312 B2
(45) Date of Patent: Sep. 12, 2023

(54) DAMPER ASSEMBLY OF A HEATING, VENTILATION, AND/OR AIR CONDITIONING (HVAC) SYSTEM

(71) Applicant: Air Distribution Technologies IP, LLC, Milwaukee, WI (US)

(72) Inventors: Edward N. Koop, Olathe, KS (US); Vikas A. Patil, Jaysingpur (IN); Jeffrey S. Beneke, Peculiar, MO (US); Kent S. Maune, Independence, MO (US); Michael A. Wingert, Blue Springs, MO (US)

(73) Assignee: AIR DISTRIBUTION TECHNOLOGIES IP, LLC, Milwaukee, WI (US)

( * ) Notice: Subject to any disclaimer, the term of this patent is extended or adjusted under 35 U.S.C. 154(b) by 226 days.

(21) Appl. No.: 17/244,531

(22) Filed: Apr. 29, 2021

(65) Prior Publication Data

US 2022/0349615 A1 Nov. 3, 2022

(51) Int. Cl.

| | |
|---|---|
| ***F24F 11/33*** | (2018.01) |
| ***F24F 11/34*** | (2018.01) |
| ***F24F 13/14*** | (2006.01) |

(52) U.S. Cl.

CPC ..... *F24F 13/14* (2013.01)

(58) Field of Classification Search

CPC . F24F 11/33; F24F 11/34; F24F 11/35; A62C 2/12; A62C 2/22; A62C 2/242; E05F 1/006

USPC ..... 454/369; 137/75; 169/57–59; 16/48.5

See application file for complete search history.

(56) References Cited

U.S. PATENT DOCUMENTS

| | | | | |
|---|---|---|---|---|
| 1,100,003 A | | 6/1914 | Watson | |
| 1,257,301 A | | 2/1918 | Ball | |
| 2,954,106 A | | 9/1960 | Schlage | |
| 3,147,830 A | | 9/1964 | Flint | |
| 4,301,569 A | | 11/1981 | McCabe | |
| 4,487,214 A | * | 12/1984 | Tatum ..... | F24F 13/15 137/72 |
| 4,559,867 A | | 12/1985 | Van Becelaere et al. | |
| 3,260,018 A | | 7/1996 | Schuh | |

(Continued)

FOREIGN PATENT DOCUMENTS

| | | |
|---|---|---|
| CA | 1165661 | 4/1984 |
| CA | 1246961 | 12/1988 |

*Primary Examiner* — Ko-Wei Lin

(74) *Attorney, Agent, or Firm* — Fletcher Yoder, PC

(57) ABSTRACT

A damper of a heating, ventilation, and/or air conditioning (HVAC) system includes a crank configured to rotate about an axis of a shaft relative to a support, a reset arm configured to rotate about the axis of the shaft relative to the support, a spring coupled to the crank and the reset arm, and a fuse link configured to be coupled to the reset arm and the support in a set configuration and to release the reset arm from the support in response to a temperature exceeding a threshold temperature. The crank and the reset arm are configured to rotate away from the support in a first circumferential direction toward a closed configuration in response to the fuse link releasing the reset arm from the support. A spring force of the spring is configured to increase to enable the reset arm to rotate in a second circumferential direction opposite to the first circumferential direction beyond the set configuration and into a reset configuration.

20 Claims, 9 Drawing Sheets

(56) References Cited

U.S. PATENT DOCUMENTS

| | | | | |
|---|---|---|---|---|
| 6,250,326 | B1 * | 6/2001 | Kimball | F16K 17/386 137/75 |
| 2007/0289631 | A1 * | 12/2007 | Higgins | F16K 27/07 137/75 |
| 2018/0311519 | A1 | 11/2018 | Jenks et al. | |

* cited by examiner

DAMPER ASSEMBLY OF A HEATING, VENTILATION, AND/OR AIR CONDITIONING (HVAC) SYSTEM

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and air conditioning (HVAC) systems are generally configured to provide temperature controlled air to an internal space. For example, various temperature and pressure control devices of the HVAC system may be controlled to generate an air flow having a particular temperature and to direct the air flow (e.g., via ductwork) to the internal space. In certain operating and/or ambient conditions, or for other reasons, portions of the HVAC system may encounter unnecessarily high temperatures. Traditional HVAC systems may employ traditional dampers having traditional fuse devices intended to enable actuation of a blade or other feature to close an air flow path of the ductwork in response to the unnecessarily high temperatures. Unfortunately, it is now recognized that traditional fuse devices may be difficult to install, maintain, and/or reset. These difficulties may increase a maintenance time and cost, and can lead to improper maintenance and poor performance of the fuse device. It is now recognized that improved devices are needed.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

An embodiment of the present disclosure includes a damper of a heating, ventilation, and/or air conditioning (HVAC) system. The damper includes a crank configured to rotate about an axis of a shaft relative to a support, a reset arm configured to rotate about the axis of the shaft relative to the support, a spring coupled to the crank and the reset arm, and a fuse link configured to be coupled to the reset arm and the support in a set configuration and to release the reset arm from the support in response to a temperature exceeding a threshold temperature. The crank and the reset arm are configured to rotate away from the support in a first circumferential direction toward a closed configuration in response to the fuse link releasing the reset arm from the support. A spring force of the spring is configured to increase as the reset arm is rotated in a second circumferential direction opposite to the first circumferential direction beyond the set configuration and into a reset configuration.

Another embodiment of the present disclosure includes a fuse device for a damper of a heating, ventilation, and/or air conditioning (HVAC) system. The fuse device includes a crank configured to rotate about an axis of a shaft relative to a support, a reset arm configured to rotate about the axis of the shaft relative to the support, a fuse link configured to be coupled to the reset arm and the support in a set configuration and to release the reset arm from the support in response to a temperature exceeding a threshold temperature, a first spring, and a second spring. The first spring is configured to bias, in response to the fuse link releasing the reset arm from the support; the crank and the reset arm in a first circumferential direction from the set configuration to a closed configuration. The second spring is coupled to the crank and the reset arm and a spring force of the second spring is configured to increase in response to rotation of the reset arm in a second circumferential direction opposite to the first circumferential direction beyond the set configuration and toward a reset configuration.

Another embodiment of the present disclosure includes a damper of a heating, ventilation, and/or air conditioning (HVAC) system. The damper includes a damper housing defining an air flow path of the HVAC system, a shaft having a first portion extending into the damper housing and a second portion extending external to the damper housing, a reset lever coupled to the second portion of the shaft, and a fuse assembly. The fuse assembly is coupled to the first portion of the shaft and configured to rotate, in response to a temperature exceeding a threshold temperature, in a first circumferential direction from a set configuration in which the air flow path is open to a closed configuration in which the air flow path is closed. The reset lever is maneuverable to rotate the fuse assembly, via the shaft, in a second circumferential direction opposite to the first circumferential direction such that a reset arm of the fuse assembly rotates in the second circumferential direction beyond the set configuration toward a reset configuration.

BRIEF DESCRIPTION OF THE DRAWINGS

Various aspects of this disclosure may be better understood upon reading the following detailed description and upon reference to the drawings in which.

DETAILED DESCRIPTION

Figure 1:
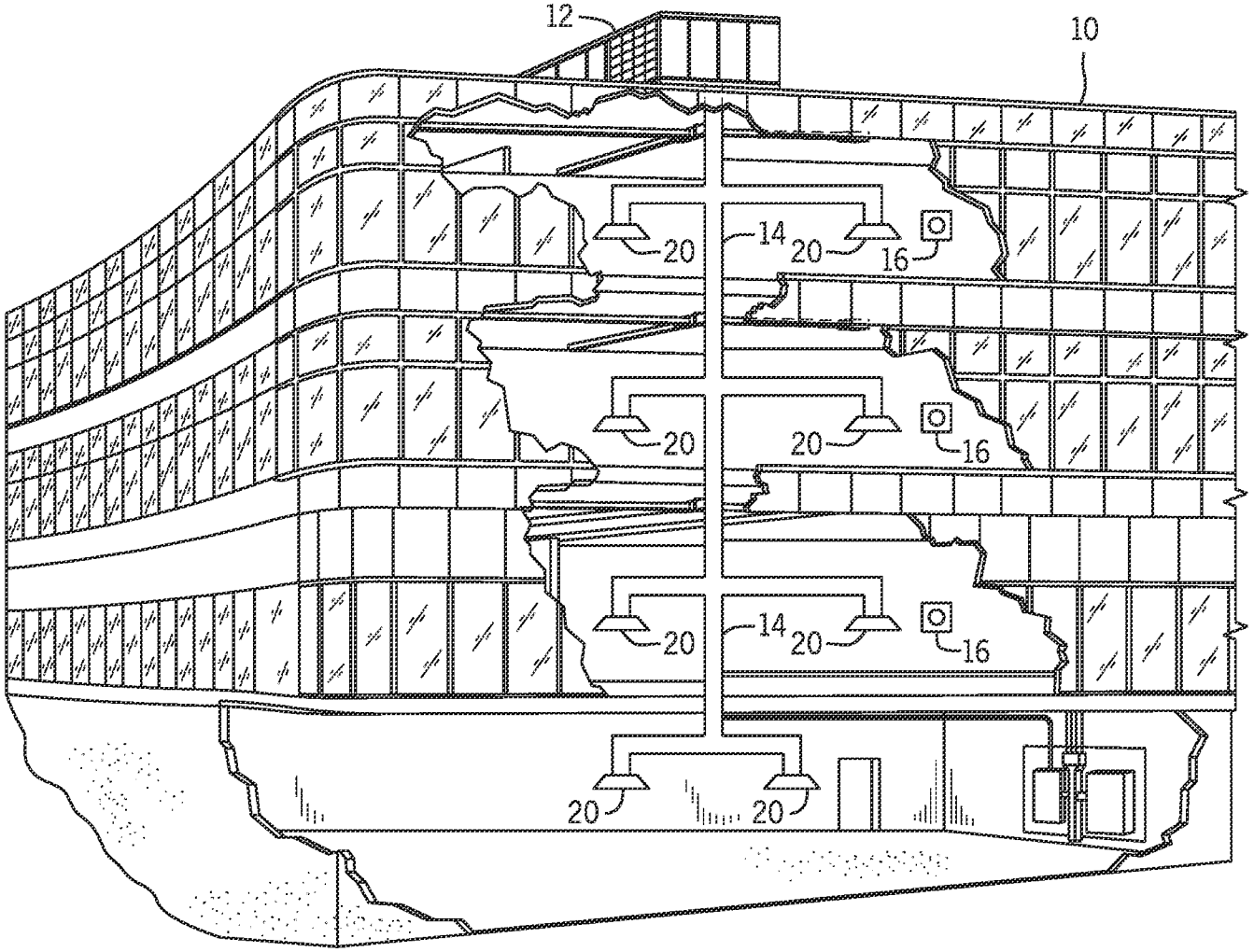
FIG. 1 is a perspective view a heating, ventilation, and air conditioning (HVAC) system for building environmental management, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure is directed to a fuse assembly for a damper used in a duct section of ductwork of a heating, ventilation, and air conditioning (HVAC) system. For example, the HVAC system may include an HVAC unit configured to condition air and to distribute the conditioned air to ductwork extending toward conditioned spaces of a building. The ductwork may include a duct section having a damper, such as a fire damper, where the damper includes a fuse assembly configured to retain the damper in an open (or set) configuration and, in response to an elevated temperature within the duct section, actuate the damper to a closed configuration. For example, the fuse assembly may include a fuse link configured to break in response to an elevated temperature, enabling actuation of certain aspects of the fuse assembly to the closed configuration. When the damper and corresponding fuse assembly are in the closed configuration, a blade of the damper may block a flow path of the duct section.

In accordance with present embodiments, the fuse assembly may include a crank configured, in certain embodiments and/or operating conditions, to rotate about an axis of a shaft relative to a support, a reset arm configured to rotate about the axis of the shaft relative to the support, and a first spring (e.g., a extension spring) coupled to and between the crank and the reset arm. The above-described fuse link may extend between a hook of the reset arm and a hook the support when the fuse assembly is in the set configuration, thereby preventing a second spring (e.g., a torsion spring) from causing rotation of the fuse assembly while the fuse assembly is in the set configuration. The fuse link may be configured to release the reset arm from the support (e.g., via a breaking of the fuse link) in response to the temperature within the duct section exceeding a threshold temperature. The threshold temperature may be defined by a material and/or geometry of the fuse link, such that the fuse link breaks in response to the elevated temperature in the duct section, thereby releasing the reset arm from the support and allowing aspects of the fuse assembly to rotate away from the support.

For example, after the fuse link breaks and releases the reset arm from the support, a spring force of the second spring (e.g., torsion spring) may cause the crank to rotate in a first circumferential direction toward the closed configuration. As the fuse assembly rotates in the first circumferential direction from the set configuration to the closed configuration, a link member coupled to and between the crank and the blade of the damper may bias the blade to close the flow path of the duct section.

After the fuse assembly is in the closed configuration, a reset lever (e.g., coupled to the shaft) extending outside of the duct section may be utilized (e.g., by an operator) to rotate aspects of the fuse assembly in a second circumferential direction opposing the first circumferential direction, such that the reset arm rotates beyond the set configuration and toward a reset configuration. For example, while the crank of the fuse assembly may be blocked from rotating beyond its normal position in the set configuration, the reset lever may enable rotation of the reset arm (e.g., via the shaft) in the second circumferential direction beyond its normal position in the set configuration and into the reset configuration, such that the hook of the reset arm and the hook of the support are closer to each other in the reset configuration than in the set configuration. The first spring (e.g., extension spring) is configured to extend in length to enable the reset arm to rotate in the second circumferential direction beyond the set configuration and into a reset configuration.

By allowing the reset arm to rotate in the second circumferential direction opposite to the first circumferential direction beyond the set configuration and into the reset configuration, a new fuse link may be more readily coupled to the reset arm and to the support. That is, the fuse link may be more readily coupled to the reset arm and to the support in the reset configuration because a distance between the hook of reset arm and the hook of the support is smaller in the reset configuration than in the set configuration. An access port in the duct section may also improve installation and maintenance by enabling the operator to couple a new fuse link to the hook of the reset arm and the hook of the support while the assembly is in the reset configuration.

The features described above, and described in additional detail below with reference to the drawings, enable improved installation procedures (e.g., setting the fuse link during first installation) and improved maintenance procedures (e.g., replacing or resetting the fuse link with a new fuse link after the fuse link releases or breaks in response to elevated temperatures in the duct section). Further, presently disclosed embodiments enable the operator to actuate the above-described fuse assembly features via an external lever, as opposed to an internal lever, which may also improve an ease of maintenance and installation procedures. These and other features are described in detail below with reference to the drawings.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10. However, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system.

The HVAC unit 12 may be an air cooled device that implements a refrigeration cycle to provide conditioned air to the building 10. Specifically, the HVAC unit 12 may include one or more heat exchangers across which an airflow is passed to condition the airflow before the airflow is supplied to the building. In the illustrated embodiment, the HVAC unit 12 is an AHU, such as a rooftop unit (RTU) which conditions a supply air stream, such as environmental air and/or a return airflow from the building 10. Outdoor units, indoor units, or other conditioning schemes are also possible. After the HVAC unit 12 conditions the air, the air is supplied to the building 10 via ductwork 14 extending throughout the building 10 from the HVAC unit 12. For example, the ductwork 14 may extend to various individual floors or other sections, such as rooms, of the building 10. Terminal units 20 associated with the floors, rooms, or other sections of the building 10 may be connected to the ductwork 14 and may be configured to distribute the airflow to the floors, rooms, or other sections of the building 10. In some embodiments, the terminal units 20 may include air conditioning features in addition to, or in the alternate of, the air conditioning features of the HVAC unit 12.

In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream. Additionally or alternatively, other HVAC equipment may be installed at the terminal units 20 or in another area of the building, such as a basement 21 (e.g., a boiler may be installed in a basement of the building 10). A control device 16, one type of which may be a thermostat, may be used to designate the temperature of the conditioned air. The control device 16 also may be used to control the flow of air from the HVAC unit 12, through the ductwork 14, to the terminal units 20, or any combination thereof. For example, the control device 16 may be used to regulate operation of one or more components of the HVAC unit 12 and/or terminal units 20. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

As previously described, the system of FIG. 1 may include the ductwork 14 configured to route conditioned air to various spaces of the building 10. The ductwork 14 may include a duct section having a damper disposed therein, the damper having a fuse assembly configured to enable actuation of the damper between a set configuration in which a flow path through the duct section is open, a closed configuration in which a blade of the damper closes the flow path, and a reset configuration in which aspects of the fuse assembly (e.g., a fuse link) are reset (e.g., during an initial installation procedure, or during a maintenance procedure to reset the fuse link). As will be described in detail with reference to the drawings below, the damper and corresponding fuse assembly are configured to improve the above-described installation procedures. For example, the fuse assembly includes a reset lever accessible from (e.g., extending to) an outside of the duct section, which may be more accessible to the operator. Further, the reset configuration described above may reduce a distance between features of the fuse assembly (e.g., a hook of a reset arm and a hook of a support) to which a fuse link is coupled, and/or may enable access via an access port in the duct section, thereby reducing a complexity of coupling the fuse link to the features of the fuse assembly (e.g., the hook of reset arm and the hook of the support). These and other aspects of the disclosure are described in detail below with reference to the drawings.

Figure 2:
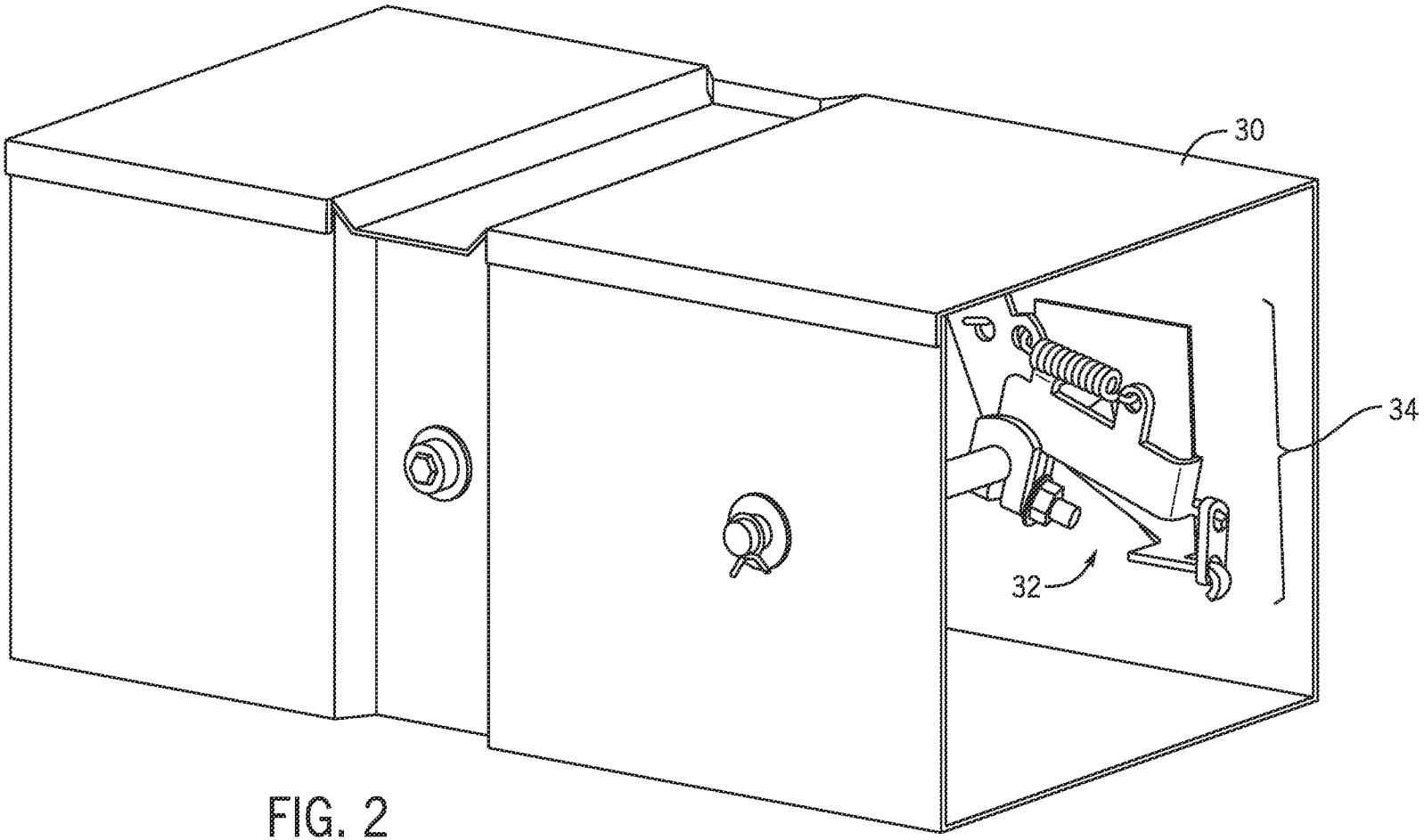
FIG. 2 is a perspective view of a duct section of ductwork of the HVAC system of FIG. 1, including a damper having a fuse assembly, in accordance with an aspect of the present disclosure.
Figure 3:
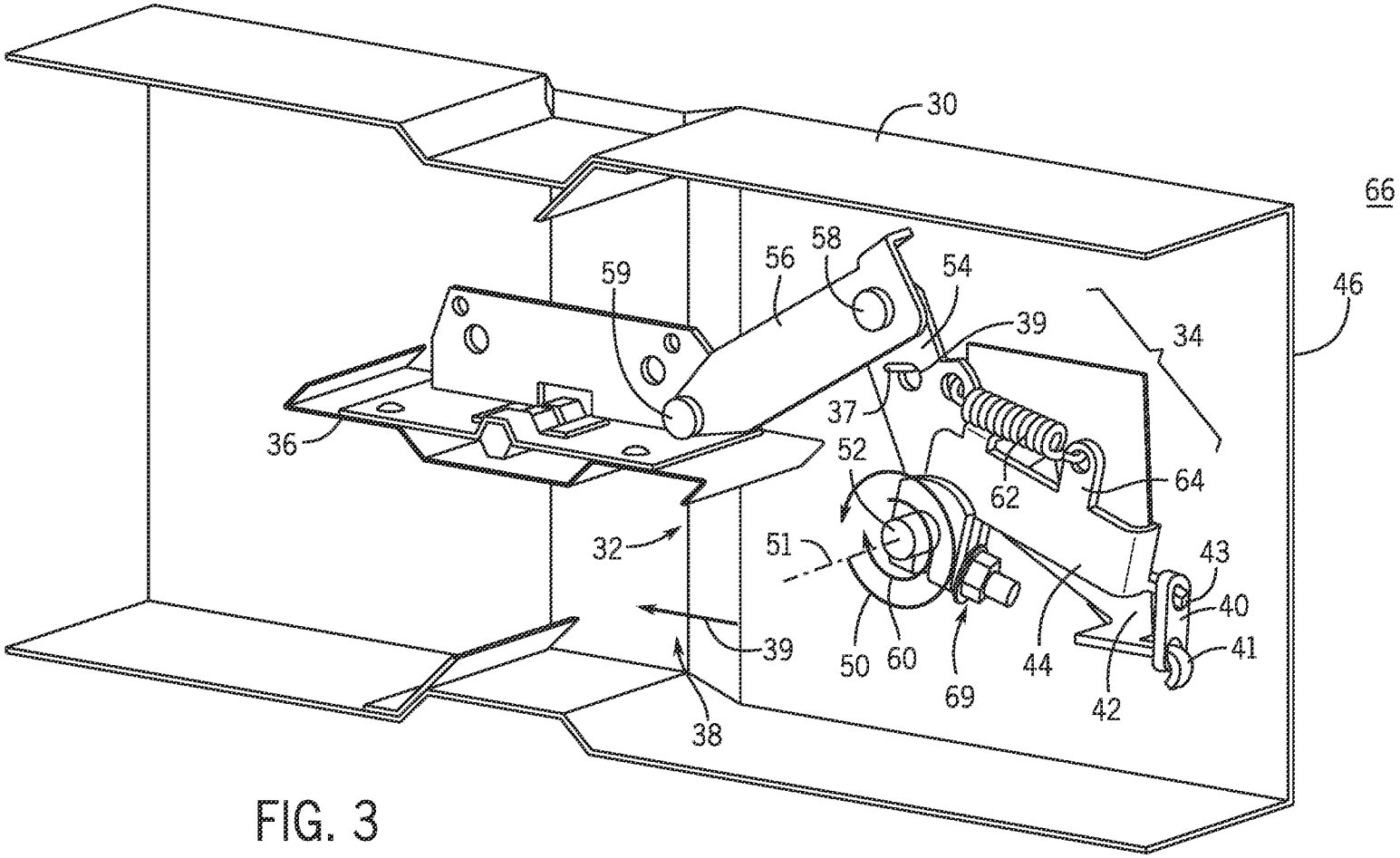
FIG. 3 is a cross-sectional perspective view of the duct section of FIG. 2, including the damper having the fuse assembly, in accordance with an aspect of the present disclosure.
Figure 4:
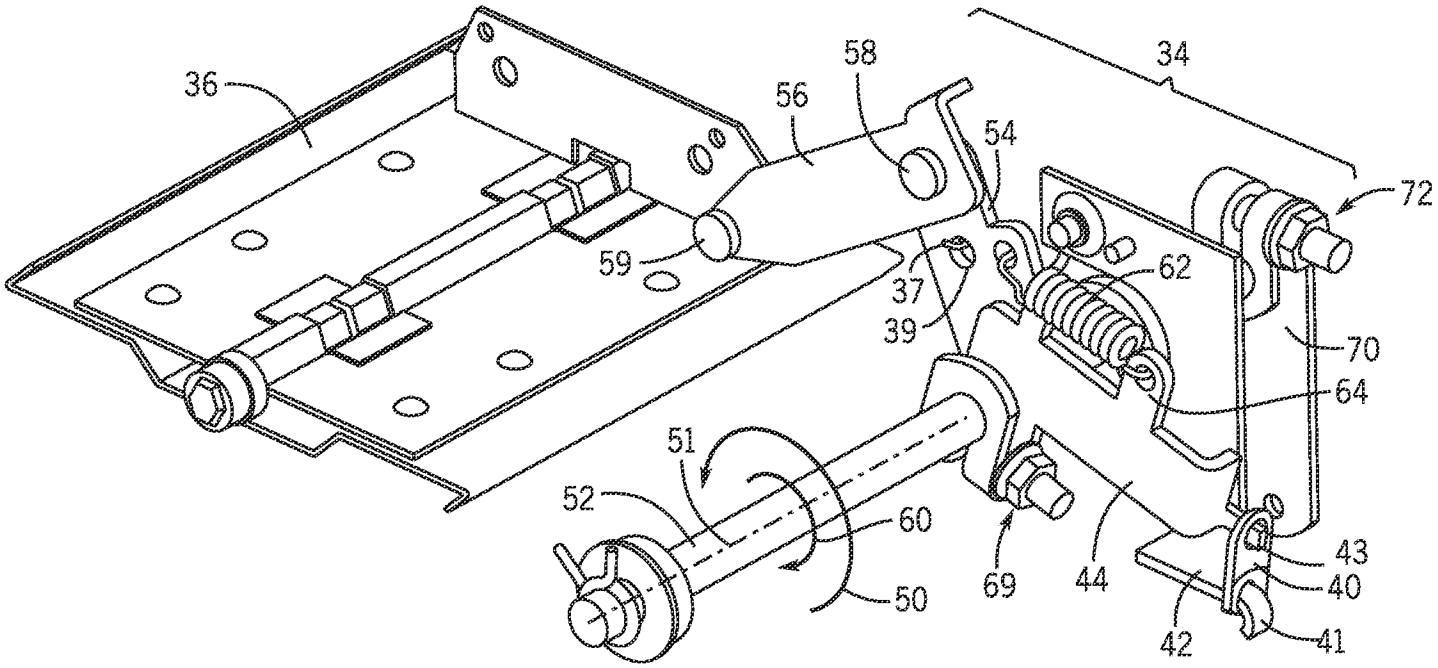
FIG. 4 is a perspective view of the damper having the fuse assembly for use in the duct section of FIG. 2, in accordance with an aspect of the present disclosure.

FIG. 2 is a perspective view of an embodiment of a duct section 30 of ductwork of the HVAC system 10 of FIG. 1, including a damper 32 having a fuse assembly 34. FIG. 3 is a cross-sectional perspective view of an embodiment of the duct section 30 of FIG. 2, including the damper 32 having the fuse assembly 34. FIG. 4 is a perspective view of an embodiment of the damper 32 having the fuse assembly 34 for use in the duct section of FIG. 2. Because many of the components of the damper 32 and corresponding fuse assembly 34 in FIG. 2 are hidden by the duct section 30, the following description refers to components illustrated and labeled in particular in FIGS. 3 and 4.

For example, focusing first on FIG. 3, the damper 32 includes the fuse assembly 34 and a blade 36 coupled to the fuse assembly 34. The damper 32 and corresponding fuse assembly 34 are illustrated in a set configuration in FIG. 3. In the set configuration, the blade 36 does not block a flow path 38 through the duct section 30. While the damper 32 and corresponding fuse assembly 34 are in the set configuration, a fuse link 40 of the fuse assembly 34 is coupled to a hook 41 of a support 42 and a hook 43 of a reset arm 44 of the fuse assembly 34. The support 42 may be mounted to a wall 46 of the duct section 30 such that the support 42 is stationary and acts as an anchor. While the damper 32 and the corresponding fuse assembly 34 are in the set configuration (e.g., the fuse link 40 is coupled to the hook 41 of the support 42 and to the hook 43 of the reset arm 44), the flow path 38 of the duct section 30 is open and a fluid flow through the flow path 38 is permitted. If a temperature within the flow path 38 exceeds a threshold temperature, the fuse link 40 may break. For example, the fuse link 40 may include a material and/or a geometry (e.g., size, width, etc.) configured to break in response to the temperature within the flow path 38 exceeding the threshold temperature. That is, the threshold temperature may be a function of the design of the fuse link 40.

When the fuse link 40 breaks, the fuse link 40 may release its coupling of the hook 43 of the reset arm 44 with the hook 41 of the support 42. Aspects of the fuse assembly 34, in response to the fuse link 40 breaking and releasing the reset arm 44 from the support 42, may be actuated via a spring force (e.g., via a torsion spring) toward a closed configuration, whereby the fuse assembly 34 causes the blade 36 of the damper 32 to close the flow path 38 in the duct section 30. While most of the torsion spring is hidden in FIG. 3, a hook 37 of the torsion spring, engaged with an opening 39 of the crank 54, is shown. The hook 37 of the torsion spring may contact the crank 54 and cause the crank 54, along with other features of the fuse assembly 34 described below, to rotate in a first circumferential direction 50 about an axis 51 of a shaft 52 of the fuse assembly 34 as a spring force of the torsion spring is released.

Further, a link member 56 of the fuse assembly 34 may be coupled to and between the crank 54 and the blade 36. The crank 54 and the link member 56 may be coupled via a pin assembly 58 such that the link member 56 can rotate relative to the crank 54 about the pin assembly 58. Further, the blade 36 may be coupled to the link member 56 via an additional pin assembly 59. Rotation of the link member 56 relative to the crank 54 about the pin assembly 58, and rotation of the blade 36 relative to the link member 56 about the additional pin assembly 59, may enable the blade 36, which extends generally horizontally in the duct section 30 while in the set configuration, to extend generally vertically in the duct section 30 while in the closed configuration. That is, in the set configuration, the blade 36 may extend generally parallel to a flow direction 39 within the flow path 38 such that the flow path 38 is open and a fluid flow is permitted. In the closed configuration, the blade 36 may extend generally perpendicular to the flow direction 39 within the flow path 38 such that the flow path 38 is closed by the blade 36.

After the damper 32 and corresponding fuse assembly 34 are in the closed configuration (e.g., after the damper blade 36 closes the flow path 38 in the duct section 30 as described above), aspects of the fuse assembly 34 may be actuated via an operator in a second circumferential direction 60 opposite to the first circumferential direction 50. For example, in FIG. 4, a reset lever 70 coupled to the shaft 52 via a bolt assembly 72 may be utilized by the operator to rotate the shaft 52 and the reset arm 44, which may be coupled to the shaft 52 via an additional bolt assembly 69, in the second circumferential direction 60. The reset arm 44 in particular may be rotated in the second circumferential direction 60 from the closed configuration, beyond the set configuration illustrated in FIGS. 3 and 4, and toward and into a reset configuration. In the reset configuration (e.g., illustrated in later drawings), the hook 43 of the reset arm 44 and the hook 41 of the support 42 are closer to each other than they otherwise would be in the set configuration illustrated in FIGS. 3 and 4.

The closer distance between the hooks 41, 43 may improve ease of setting a new fuse link (e.g., to replace the fuse link 40 after it breaks) while the reset arm 44 is in the position corresponding to the reset configuration. Further, an access opening in the duct section 30 of FIG. 3 positioned adjacent the hook 41 of the support 42 may enable the operator to set the new fuse link onto the hooks 41, 43 while the reset arm 44 is in the position corresponding to the reset configuration. Further still, the reset lever 70 in FIG. 4 may be coupled to the shaft 52 in an area 66 external to the duct section 30 (i.e., the external area 66 illustrated in FIG. 3). In other words, the reset lever 70 of FIG. 4 may extend into the external area 66 in FIG. 3. By positioning the reset lever 70 in FIG. 4 in the external area 66 illustrated in FIG. 3, the reset lever 70 is more readily accessed by an operator for positioning the fuse assembly 34 in the above-described reset configuration during first installation and/or a maintenance procedure.

Focusing again on FIG. 3, the extension spring 62, which is coupled to an extension 64 of the reset arm 44 and to the crank 54, may expand in length (e.g., may be tensed) in response to rotating the reset arm 44 in the second circumferential direction 60 beyond the set configuration and into the reset configuration. After a new fuse link is attached to the hook 41 of the support 42 and the hook 43 of the reset arm 44 while the fuse assembly 34 is in the reset configuration, the extension spring 62 may contract in length (e.g., a portion of tension may be released) to enable the reset arm 44 to rotate about the axis 51 of the shaft 52 in the first circumferential direction 50 back to its position corresponding to the set configuration.

Figure 5:
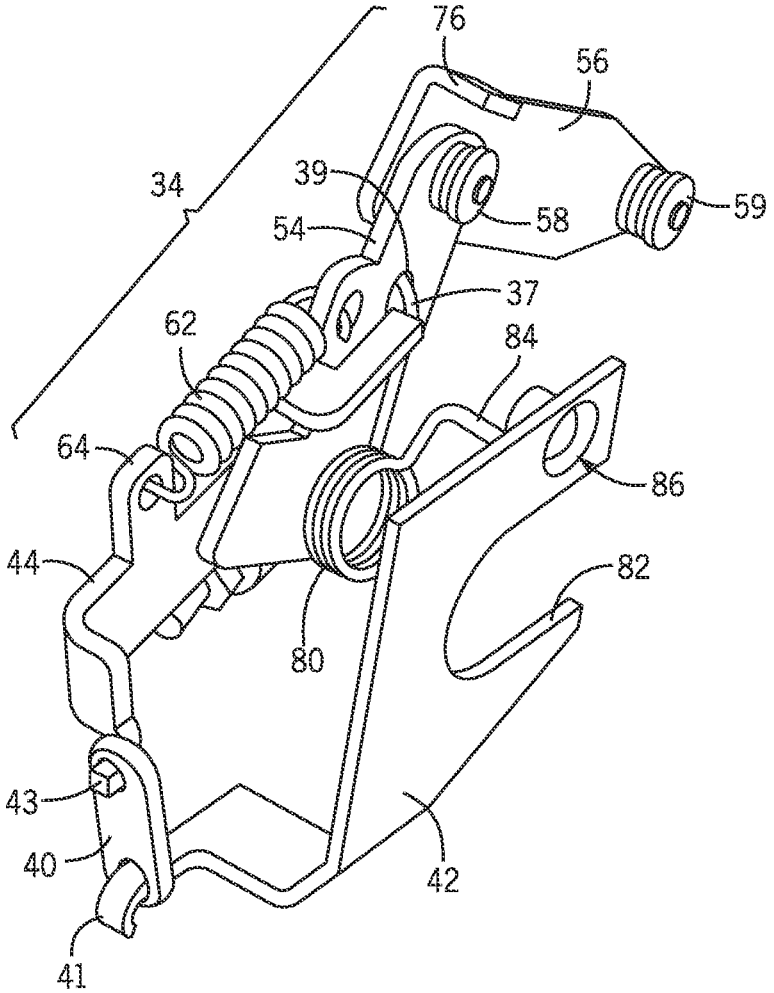
FIG. 5 is a back perspective view of a portion of the fuse assembly for use with the damper and in the duct section of FIG. 2, in accordance with an aspect of the present disclosure.

The set configuration, the closed configuration, and the reset configuration described above are illustrated in FIGS. 6-8 and described in detail below. However, first, FIG. 5 is a back perspective view of an embodiment of a portion of the fuse assembly 34 for use in the duct section of FIG. 2. In the embodiment illustrated in FIG. 5, the shaft 52 illustrated in FIGS. 3 and 4 is not shown. However, it should be understood that the shaft 52 illustrated in FIGS. 3 and 4 may extend, with reference to FIG. 5, through a U-shaped curvature 82 formed in the support 42, through a torsion spring 80 of the fuse assembly 34, and through the crank 54 and the reset arm 44 of the fuse assembly 34.

The torsion spring 80 in the illustrated embodiment includes an arm 84 coupled to the support 42 via upon a rivet assembly 86. Upon a breaking of the fuse link 40 in response to a temperature exceeding a threshold temperature, the torsion spring 80 may bias the crank 54 from the set configuration toward the closed configuration via the hook 37 of the torsion spring 80 extending through the opening 39 in the crank 54. For example, the fuse link 40, in the set configuration, may effectively block the torsion spring 80 from biasing the crank 54 toward and into the closed configuration (e.g., by way of the extension spring 62 extending between, and coupling to, the extension 64 of the reset arm 44 and the crank 54). After the fuse link 40 is broken, a spring force (e.g., torque) of the torsion spring 80 against the crank 54 causes the crank 54 (and the reset arm 44 via the extension spring 62) to rotate away from the hook 41 of the support 42.

As previously described, the pin assembly 58 coupling the crank 54 and the link member 56 may enable the link member 56 to rotate about the pin assembly 58 relative to the crank 54. The link member 54 may include a lip 76 that prevents over-rotation of the link member 56 relative to the crank 54. That is, the lip 76 may permit the link member 56 to rotate about the pin assembly 58 relative to the crank 54 until the link member 56 is generally in-line with the crank 54, and then may block the link member 56 from further rotation. The pin assembly 59 illustrated in FIG. 5, as previously described, may be utilized to couple the link member 56 with a blade (e.g., the blade 36 illustrated in FIGS. 3 and 4).

Figure 6:
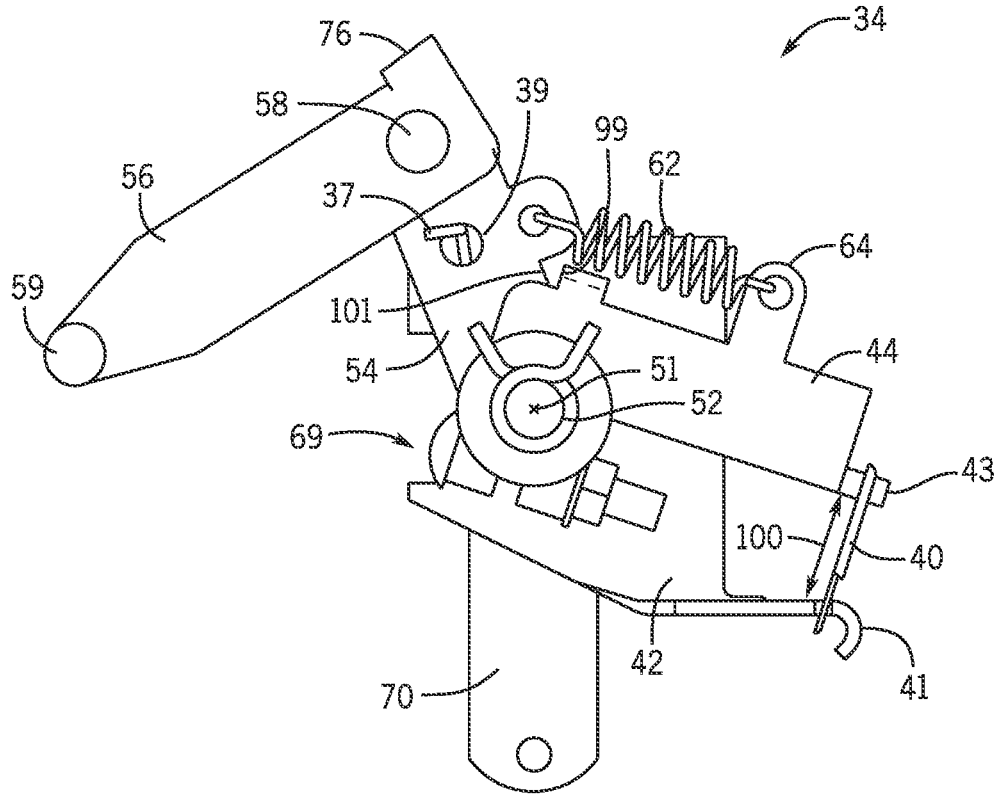
FIG. 6 is a side view of the fuse assembly for use with the damper and in the duct section of FIG. 2, the fuse assembly being in a set configuration, in accordance with an aspect of the present disclosure.
Figure 7:
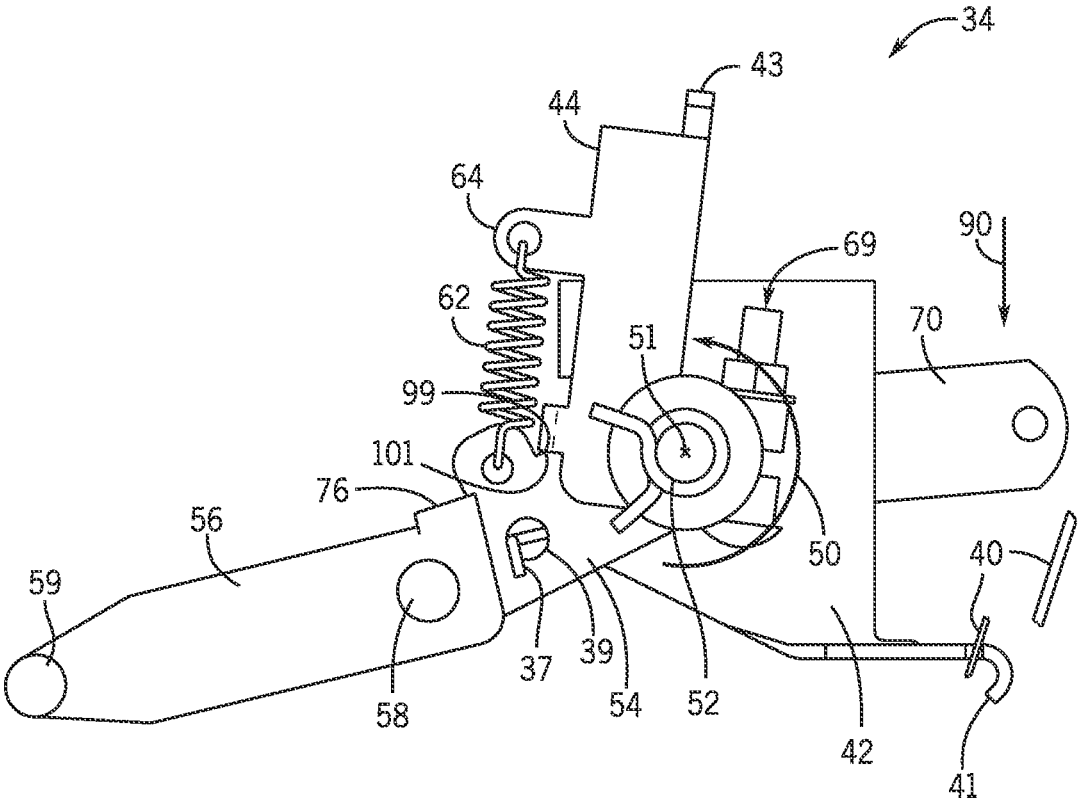
FIG. 7 is a side view of the fuse assembly for use with the damper and in the duct section of FIG. 2, the fuse assembly being in a closed configuration, in accordance with an aspect of the present disclosure.
Figure 8:
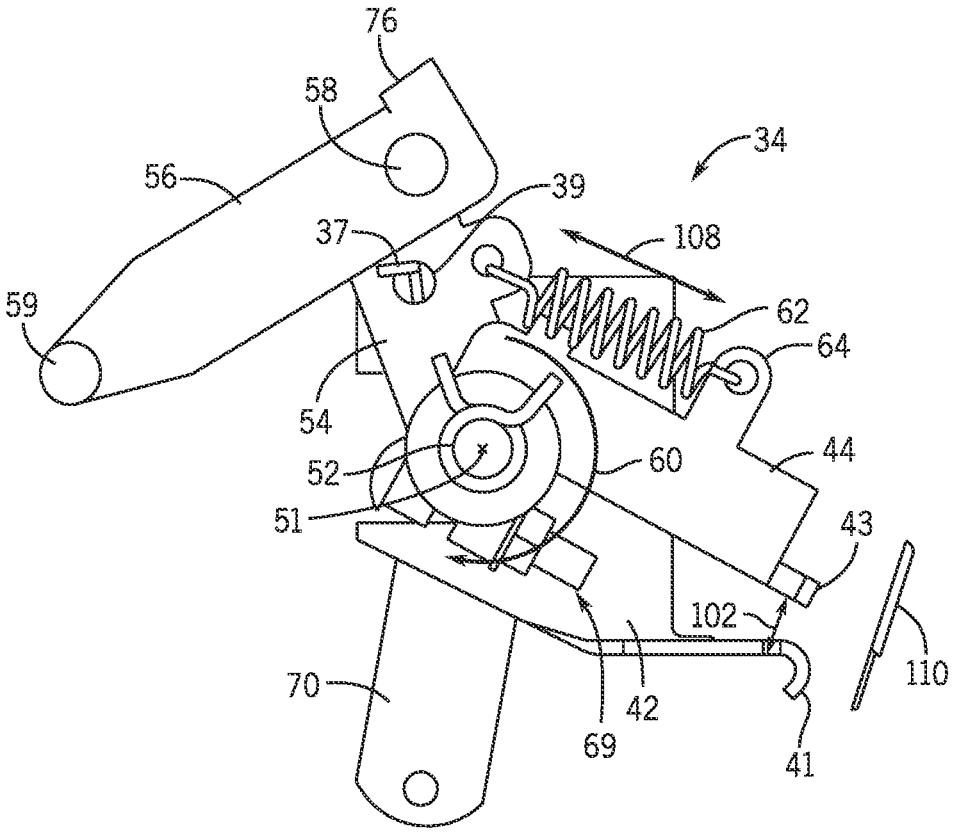
FIG. 8 is a side view of the fuse assembly for use with the damper and in the duct section of FIG. 2, the fuse assembly being in a reset configuration, in accordance with an aspect of the present disclosure.

FIGS. 2-5 generally illustrate a condition in which the fuse assembly 34 is in a set configuration (e.g., the fuse link 40 is coupled to the hook 41 of the support 42 and the hook 43 of the reset arm 44), as previously described. FIGS. 6-8 illustrate side views of the fuse assembly 34 in the set configuration, the closed configuration, and the reset configuration, respectively. For example, first, FIG. 6 is a side view of an embodiment of the fuse assembly 34 for use in the duct section of FIG. 2, the fuse assembly 34 being in the set configuration. As previously described, in the set configuration, the fuse link 40 is engaged with the hook 41 of the support 42 and the hook 43 of the reset arm 44. If a temperature proximate the fuse link 40 exceeds a threshold temperature, as previously described, the fuse link 40 may break.

FIG. 7 is a side view of an embodiment of the fuse assembly 34 for use in the duct section of FIG. 2, the fuse assembly 34 being in a closed configuration after the fuse link 40 breaks (e.g., in response to the temperature exceeding the threshold temperature, as described above with respect to FIG. 6). In FIG. 7, only the hook 37 of the torsion spring is shown. Upon a breaking of the fuse link 40, the torsion spring releases a spring force (e.g., via the hook 37), such as a torque, against the crank 54, causing the crank 54 to rotate in the first circumferential direction 50. Of course, as previously described, the extension spring 62 extends between the extension 64 of the reset arm 44 and the crank 54. Accordingly, as the crank 54 rotates, the reset arm 44 also rotates. Further, the shaft 52 is coupled to the reset arm 44 and rotates with the reset arm 44 and the crank 54. Further still, the reset lever 70 is coupled to the shaft 52 and rotates with the shaft 52, the reset arm 44, and the crank 54, as shown.

The crank 54 is also coupled to the link member 56 via the pin assembly 58. As previously described, the pin assembly 58 enables rotation of the link member 56 with respect to the crank 54. Accordingly, while the link member 56 and the crank 54 form an angle in FIG. 6, the link member 56 is in an in-line position relative to the crank 54 in FIG. 7. The lip 76 of the link member 56 may contact the crank 54 to block the link member 56 from over-rotating beyond the illustrated in-line position. Further, as illustrated in FIG. 7, the extension spring 62 may contract such that the reset arm 44 rotates in the first circumferential direction 50 relative to the crank 54, until an edge 99 of the reset arm 44 contacts an edge 101 of the crank 54. The contact between the edge 99 of the reset arm 44 and the edge 101 of the crank 54 may block further rotation of the reset arm 44 relative to the crank 54.

As shown in FIG. 7, a force 90 may be exerted (e.g., by an operator) on the reset lever 70 to rotate the fuse assembly 34 from the closed configuration in FIG. 7 toward and into the reset configuration illustrated in FIG. 8. For example, as previously described, the reset lever 70 may be coupled to the shaft 52, which may be coupled to the reset arm 44 via the bolt assembly 69. As the force 90 is applied to the reset lever 70 as illustrated in FIG. 7, the reset lever 70 may rotate the shaft 52 and the reset arm 44 in a second circumferential direction 60 as illustrated in FIG. 8. Further, the reset lever 70 in FIG. 8 may be turned in the second circumferential direction 60 beyond a position of the reset lever 70 illustrated in the set configuration in FIG. 6, such that the reset arm 44, via the shaft 52 extending between the reset lever 70 and the reset arm 44, is biased in the second circumferential direction 60 beyond a position of the reset lever 44 illustrated in the set configuration in FIG. 6. This can be observed in view of the relative distances between the hook 43 of the reset arm 44 and the hook 41 of the support 42 illustrated in FIGS. 6 and 8. For example, a distance 100 in FIG. 6 between the hook 43 of the reset arm 44 and the hook 41 of the support 42 is greater than a distance 102 in FIG. 8 between the hook 43 of the reset arm 44 and the hook 41 of the support 42. As the reset lever 70 is moved in the second circumferential direction 60 as shown in FIG. 8, a length 108 of the extension spring 62 may expand or extend, enabling the hook 43 of the reset arm 44 to be closer to the hook 41 of the support 42. The closer distance 102 in FIG. 8 between the hook 41 and the hook 43 may improve an ease of setting a new fuse link 100 on the hook 41 and the hook 43.

After the new fuse link 100 is set, the reset lever 70 may be released back to the position illustrated in FIG. 6 and corresponding to the set configuration. Further, a portion of the tension in the extension spring 62 caused by the expanded or extended length 108 in the reset configuration may be released as the assembly moves back toward the set configuration illustrated in FIG. 6.

It should be noted that in any of the embodiments illustrated in FIGS. 2-8, a torsion spring may be used in place of the extension spring 62 and the system may be modified to accommodate the design differences. Further, in any of the embodiments illustrated in FIGS. 2-8, an extension spring may be used in place of the torsion spring 80 and the system may be modified to accommodate the design differences. The extension spring 62 and the torsion spring 80 illustrated in FIGS. 2-8 are provided as examples but are not limiting on the present disclosure.

Figure 9:
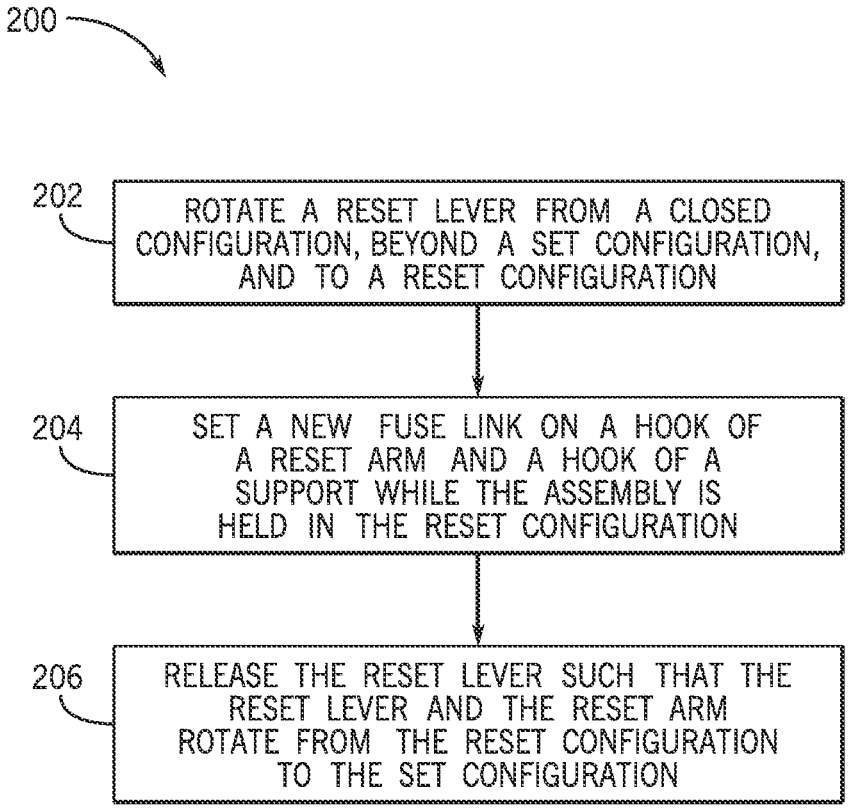
FIG. 9 is an illustration of a method of operating a damper and corresponding fuse assembly for use in the duct section of FIG. 2, in accordance with an aspect of the present disclosure.

FIG. 9 is an illustration of an embodiment of a method 200 of operating (e.g., setting or resetting) a damper and corresponding fuse assembly for use in the duct section of FIG. 2. As previously described, in practice, the fuse assembly may include a fuse link coupling a reset arm of the fuse assembly to a support. This configuration may be referred to as a set configuration. If a temperature around the fuse link exceeds a threshold temperature, the fuse link may break. A force in a spring (e.g., a torque in a torsion spring) may exert a force against a crank of the fuse assembly. The crank of the fuse assembly may be coupled to the reset arm via a spring (e.g., an extension spring). The force exerted by the torsion spring against the crank may cause the crank, after the fuse link breaks, to rotate toward a closed configuration in which a blade coupled to the crank via a link member closes a flow path of the duct section. Of course, the reset arm may rotate with the crank via the coupling of the reset arm and the crank by the extension spring. The illustrated method 200, described in detail below, refers to a process of resetting the fuse link during a maintenance procedure and/or setting the fuse link for the first time in an initial installation procedure.

In the illustrated embodiment, the method 200 includes rotating (block 202) a reset lever coupled to the reset arm via a shaft from the above-described closed configuration, beyond the above-described set configuration, and to a reset configuration. As previously described, rotating the reset lever such that the reset arm (via the shaft) rotates beyond the set configuration and into the reset configuration reduces a distance between the reset arm and the support (e.g., compared to the set configuration). While rotating the reset arm beyond the set configuration and into the reset configuration, a spring (e.g., extension spring) between the reset arm and the crank of the fuse assembly may extend or expand in length (e.g., such that a tension in the extension spring increases). As previously described, the reset lever may extend into an area external to the duct section such that the reset lever is accessible by the operator external to the duct section, which may improve an ease of rotating the assembly.

The method 200 also includes setting (block 204) a new fuse link onto a hook of the reset arm and onto a hook of the support while the assembly is held in the reset configuration. For example, an access port in the duct section may enable the operator to reach into the duct section and place the new fuse link onto the reset arm and onto the hook while the assembly is held in place (e.g., via the external reset lever) in the reset configuration.

The method 200 also includes releasing (block 206) the reset lever such that the reset lever and the reset arm (e.g., by way of a coupling therebetween to a shaft) rotate from the reset configuration back to the set configuration. When the reset lever is released, the extension spring extending between the reset arm and the crank may contract in length (e.g., a tension in the extension spring may be reduced) as the reset arm rotates back toward the crank and into the set configuration. After the assembly is in the set configuration, the method 200 may be complete.

One or more of the disclosed embodiments, alone or in combination, may provide one or more technical effects useful in installing and maintaining a damper for use in a duct section of ductwork associated with an HVAC system. For example, disclosed embodiments improve an ease of setting a fuse link associated with a fuse assembly of the damper, and an ease of moving the fuse assembly to a particular configuration in which the fuse link is set, as described in detail above with reference to the drawings.

While only certain features and embodiments of the disclosure have been illustrated and described, many modifications and changes may occur to those skilled in the art, such as variations in sizes, dimensions, structures, shapes and proportions of the various elements, values of parameters including temperatures and pressures, mounting arrangements, use of materials, colors, orientations, etc., without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A damper of a heating, ventilation, and/or air conditioning (HVAC) system, the damper comprising:

a crank configured to rotate about an axis of a shaft relative to a support;

a reset arm configured to rotate about the axis of the shaft relative to the support;

a spring coupled to the crank and the reset arm; and a fuse link configured to be coupled to the reset arm and the support in a set configuration and to release the reset arm from the support in response to a temperature exceeding a threshold temperature, wherein the crank and the reset arm are configured to rotate away from the support in a first circumferential direction toward a closed configuration in response to the fuse link releasing the reset arm from the support, and a spring force of the spring is configured to increase as the reset arm is rotated in a second circumferential direction opposite to the first circumferential direction beyond the set configuration and into a reset configuration.

2. The damper of claim 1, wherein the spring comprises an extension spring, and the spring force in the extension spring is configured to increase as the reset arm is rotated in the second circumferential direction opposite to the first circumferential direction beyond the set configuration and into the reset configuration.

3. The damper of claim 1, comprising an additional spring configured to bias the crank and the reset arm in the first circumferential direction from the set configuration toward the closed configuration in response to the fuse link releasing the reset arm from the support.

4. The damper of claim 3, wherein the additional spring comprises a torsion spring.

5. The damper of claim 3, comprising:

a blade; and a mechanical link coupled to the blade and the crank, wherein the additional spring is configured to bias the crank, the reset arm, the mechanical link, and the blade from the set configuration toward the closed configuration in response to the fuse link releasing the reset arm, and the blade is configured to close a flow path of the damper in the closed configuration.

6. The damper of claim 1, wherein the reset arm is configured to rotate in the second circumferential direction relative to the crank beyond the set configuration and to the reset configuration.

7. The damper of claim 1, wherein the crank, the reset arm, the spring, and the fuse link are configured to be disposed in a duct.

8. The damper of claim 7, comprising a reset lever maneuverable to rotate the reset arm toward and beyond the set configuration and into the reset configuration, wherein the reset lever is configured to be positioned outside of the duct.

9. The damper of claim 8, comprising the shaft, wherein the shaft includes a first portion configured to extend outside of the duct and to couple to the reset lever, and the shaft includes a second portion configured to extend inside of the duct and to couple to the reset arm.

10. The damper of claim 1, wherein the reset arm comprises a first hook to which the fuse link is configured to be coupled, the support comprises a second hook to which the fuse link is configured to be coupled, and the reset arm and the support are configured such that a distance between the first hook and the second hook is greater in the set configuration than in the reset configuration.

11. A fuse device for a damper of a heating, ventilation, and/or air conditioning (HVAC) system, the fuse device comprising:

a crank configured to rotate about an axis of a shaft relative to a support;

a reset arm configured to rotate about the axis of the shaft relative to the support;

a fuse link configured to be coupled to the reset arm and the support in a set configuration and to release the reset arm from the support in response to a temperature exceeding a threshold temperature;

a first spring configured to bias, in response to the fuse link releasing the reset arm from the support; the crank and the reset arm in a first circumferential direction from the set configuration to a closed configuration; and a second spring coupled to the crank and the reset arm, wherein a spring force of the second spring is configured to increase in response to rotation of the reset arm in a second circumferential direction opposite to the first circumferential direction beyond the set configuration and toward a reset configuration.

12. The fuse device of claim 11, wherein the first spring comprises a torsion spring and the second spring comprises an extension spring.

13. The fuse device of claim 11, comprising:

the shaft; and a reset lever disposed on an end of the shaft, wherein the reset lever is maneuverable to rotate the reset arm and the crank, via the shaft, in the second circumferential direction toward the set configuration, and to rotate the reset arm, via the shaft, in the second circumferential direction beyond the set configuration and toward the reset configuration.

14. The fuse device of claim 11, wherein the reset arm is configured to rotate in the second circumferential direction relative to the crank beyond the set configuration and into the reset configuration.

15. The fuse device of claim 11, comprising a blade coupled directly to the crank or to a mechanical link between the crank and the blade.

16. A damper of a heating, ventilation, and/or air conditioning (HVAC) system, the damper comprising:

a damper housing defining an air flow path of the HVAC system;

a shaft having a first portion extending into the damper housing and a second portion extending external to the damper housing;

a reset lever coupled to the second portion of the shaft; and a fuse assembly coupled to the first portion of the shaft and configured to rotate, in response to a temperature exceeding a threshold temperature, in a first circumferential direction from a set configuration in which the air flow path is open to a closed configuration in which the air flow path is closed, wherein the reset lever is maneuverable to rotate the fuse assembly, via the shaft, in a second circumferential direction opposite to the first circumferential direction such that a reset arm of the fuse assembly rotates in the second circumferential direction beyond the set configuration toward a reset configuration.

17. The damper of claim 16, comprising:

a support; and a fuse link coupled to the support and the reset arm of the fuse assembly, wherein the fuse link is configured to release the reset arm from the support in response to the temperature exceeding the threshold temperature to enable the fuse assembly to rotate in the first circumferential direction from the set configuration to the closed configuration.

18. The damper of claim 16, comprising a first spring configured to bias the fuse assembly in the first circumferential direction.

19. The damper of claim 18, comprising a crank of the fuse assembly and a second spring coupled to the crank and the reset arm, wherein the reset lever is maneuverable to rotate the crank and the reset arm in the second circumferential direction from the closed configuration to the set configuration, wherein the lever is maneuverable to rotate the reset arm in the second circumferential direction away from the crank and beyond the set configuration toward the reset configuration, wherein a spring force of the second spring is configured to increase as the reset arm is rotated in the second circumferential direction away from the crank and beyond the set configuration toward the reset configuration, and wherein the second spring is configured to contract to enable the reset arm to rotate in the first circumferential direction from the reset configuration toward the crank and into the set configuration.

20. The damper of claim 19, wherein the first spring comprises a torsion spring and the second spring comprises an extension spring.

* * * * *